US007618275B2

(12) United States Patent
Owen, Sr. et al.

(10) Patent No.: US 7,618,275 B2
(45) Date of Patent: Nov. 17, 2009

(54) VENTED SOCKET

(75) Inventors: Robert H. Owen, Sr., Columbia City, IN (US); Mark Molinaro, Leo, IN (US)

(73) Assignee: Federal Mogul Corporation, Southfield, MI (US)

( * ) Notice: Subject to any disclaimer, the term of this patent is extended or adjusted under 35 U.S.C. 154(b) by 0 days.

(21) Appl. No.: 11/938,549

(22) Filed: Nov. 12, 2007

(65) Prior Publication Data

US 2008/0113523 A1 May 15, 2008

Related U.S. Application Data

(60) Provisional application No. 60/865,469, filed on Nov. 13, 2006.

(51) Int. Cl.
*H01R 4/60* (2006.01)

(52) U.S. Cl. ..... 439/206; 439/699.2

(58) Field of Classification Search ..... 439/206, 439/699.2, 356, 918, 602; 29/877
See application file for complete search history.

(56) References Cited

U.S. PATENT DOCUMENTS

| | | | | |
|---|---|---|---|---|
| 3,716,818 | A | 2/1973 | Finkelstein | |
| RE28,710 | E | 2/1976 | Finkelstein | |
| 4,921,124 | A | 5/1990 | Stammler et al. | |
| 4,940,422 | A | 7/1990 | Forish et al. | |
| 4,958,429 | A | 9/1990 | Forish et al. | |
| 5,000,702 | A | 3/1991 | Forish et al. | |
| 5,522,769 | A | 6/1996 | DeGuiseppi | |
| 5,642,935 | A | 7/1997 | Schmitt | |
| 5,775,794 | A | 7/1998 | Schmitt | |
| 5,800,183 | A | 9/1998 | Paul et al. | |
| 5,980,074 | A | 11/1999 | Hwang | |
| 6,039,579 | A | 3/2000 | Paul et al. | |
| 6,113,407 | A | 9/2000 | Martin | |
| 6,210,014 | B1 | 4/2001 | Kubizne et al. | |
| 2006/0040566 | A1 * | 2/2006 | Thomas et al. | 439/699.2 |

FOREIGN PATENT DOCUMENTS

| | | |
|---|---|---|
| DE | 25 17 235 | 10/1976 |
| DE | 19546370 | 6/1996 |
| EP | 0384968 | 9/1990 |
| GB | 2296315 | 6/1996 |

* cited by examiner

*Primary Examiner*—Hien Vu
(74) *Attorney, Agent, or Firm*—Robert L. Stearns; Dickinson Wright, PLLC

(57) ABSTRACT

A lamp and socket assembly (10) comprises a housing (12) including a socket cavity (25). The socket cavity (25) is defined by side walls and a bottom wall (80). A vent hole (82) passes though the bottom wall (80) of the socket cavity. A lamp (16) has a lamp base (17). A lamp socket (14) is disposed in the socket cavity (25) and includes a through passage (42) for receiving the lamp base (17) and at least one retaining finger (38*a*, 38*b*) for retaining the lamp base (17) in the through passage (42). An electrical contact insert (26) is received in the socket cavity (25). A plurality of electrical contacts (28) are received in and retained by the contact insert (26). A plurality of blade terminals (46) are interlocked with the contact insert (26), with respective ones of the contacts (28), and with the housing (12). A hydrophobic and/or oleophobic vent patch (83) is disposed in the socket cavity (25) and completely covers the vent hole (82) to permit trapped vapors and gasses to escape while repelling water and/or oil.

16 Claims, 10 Drawing Sheets

VENTED SOCKET

CROSS REFERENCE TO RELATED APPLICATIONS

This application claims the benefit of priority to U.S. Provisional Patent Application No. 60/865,469 filed Nov. 13, 2006.

BACKGROUND OF THE INVENTION

1. Field of the Invention

The subject invention relates to lamp socket assemblies and in particular to vented lamp socket assemblies of the type used in tail lights of automobiles and the like.

2. Related Art

All sealed automotive lamp assemblies must address pressure rises due to the heat generated by the lamp, material outgassing, as well as from moisture intrusion. According to prior art techniques, this problem is usually addressed through some type of vent system to equalize pressure within the enclosure and allow moisture to escape. Such vents most often take the form of a hole formed through the lamp housing. The hole is sometimes left open, but there is concern with dirt and excessive water intrusion such that manufacturers often cover the vent hole to prevent dirt and water from entering the lamp enclosure. The cover can be in the form of a tube, a hydrophobic membrane, or a combination hydrophobic vent with a cap-like construction. However, exposed hydrophobic vents are susceptible to damage affecting performance. Also, the manufacturing step of forming the hole in the lamp housing is a time consuming and expensive operation.

Examples of vent systems that employ a hydrophobic memberant include U.S. Pat. No. 4,921,124 that describes a two-piece vent device with a hydrophobic membrane installed as a plug from the outside of an electronic control device. U.S. Pat. No. 5,800,183 discloses a socket for a sealed automotive lamp, where the socket includes a vent in its base fitted with a hydrophobic vent patch applied as a plug from the outside of the socket. U.S. Pat. No. 6,113,407 teaches a socket for an electrical connection that includes an externally applied hydrophobic vent patch. And, U.S. Pat. No. 6,210,014 discloses a sealed vehicle headlamp including externally applied hydrophobic vent patches in the side of a reflector housing.

These prior art examples include many drawbacks and shortcomings. For examples, these prior art techniques are susceptible to abrasive damage and are not particularly conducive to fully automated manufacturing processes. These venting system are designed within the lamp constructions, which complicates the constructions and are thus more expensive. Furthermore, the visual impact of these externally applied vent patches are bothersome, and often compel some type of camouflaging feature to hide the vent patch.

Accordingly, there is a need for an improved lamp assembly that eliminates the need to place a hole in the lamp housing, and also eliminates any form of exposed vent to damage. Such an improved lamp assembly should have an improved placement of the venting device, as well as an improved method for installing the venting device that is economical and readily incorporated into high-volume production operations.

SUMMARY OF THE INVENTION

The present invention overcomes the disadvantages of the above described prior art by providing an improved lamp and socket assembly comprising a housing including a socket cavity. The socket cavity is defined by side walls and a bottom wall. A vent hole passes though the bottom wall of the socket cavity. A lamp has a lamp base. A lamp socket is disposed in the socket cavity and includes a through passage for receiving the lamp base and at least one retaining finger for retaining the lamp base in the through passage. An electrical contact insert is received in the socket cavity. A plurality of electrical contacts are received in and retained by the contact insert. A plurality of blade terminals are interlocked with the contact insert, with respective ones of the contacts, and with the housing. A hydrophobic and/or oleophobic vent patch is disposed in the socket cavity and completely covers the vent hole.

A method for venting moisture from the confines of a sealed lamp assembly through a vent opening in the socket is also contemplated. The method comprises the steps of: providing a housing having a socket cavity defined by side walls and a bottom wall; forming a vent hole though the bottom wall of the socket cavity; inserting a lamp socket in the socket cavity of the housing; inserting the base of a lamp in the lamp socket; forming a vent patch from a hydrophobic and/or oleophobic fabric material; and covering the vent hole with a vent patch applied from the inside of the socket cavity.

The assembly and method according to this invention are particularly conducive to fully automated manufacturing processes which result in product being manufactured at minimal cost and effort. The internally applied vent patch is far less susceptible to abrasive damage, and therefore functions as intended over a generally longer service life than do comparable prior art examples. Furthermore, the subject technique has shown better moisture evacuation over prior art venting methods. The invention eliminates the need to design a venting system within the lamp construction, as taught by many prior art systems. Rather, the vent system is incorporated into the socket feature, thus making the design and construction of the lamp housing less costly. By eliminating the hole through the housing, as taught by prior art designs, a potential visual impact is also avoided. Likewise, there is no need to employ camouflaging features that hide unsightly vent patch.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
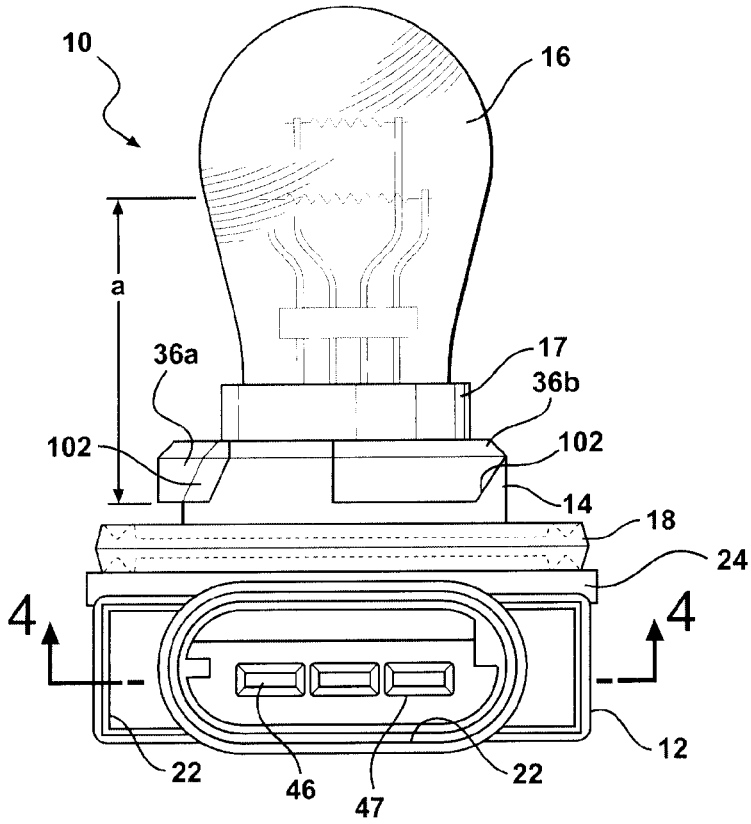
FIG. 1 is a front elevational view of the lamp socket assembly according to the present invention.
Figure 2:
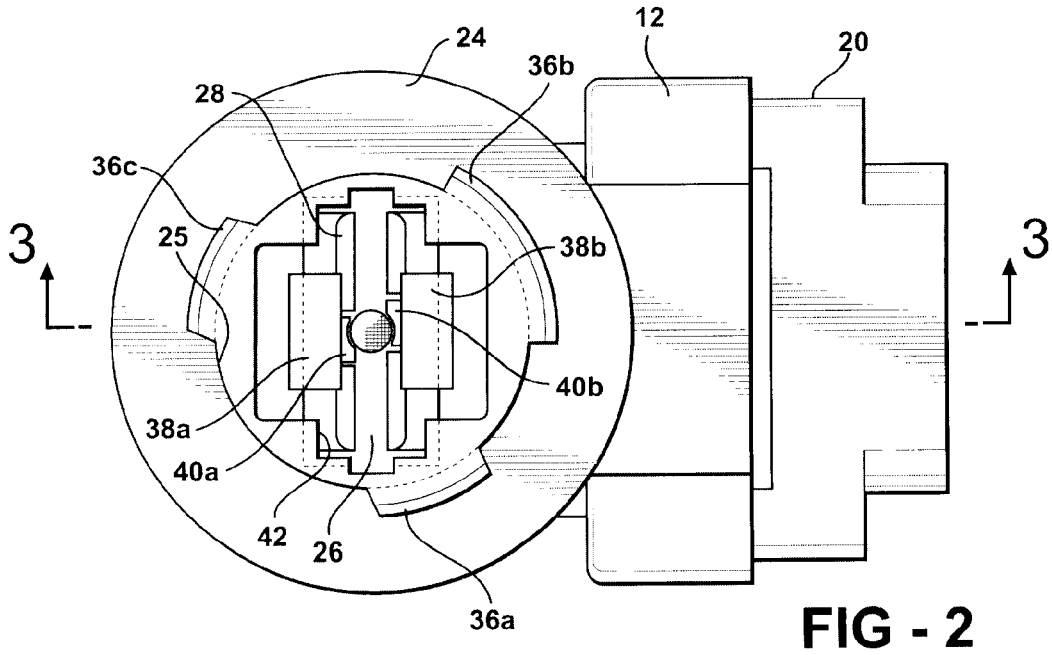
FIG. 2 is a top plan view of the socket assembly of FIG. 1 rotated through 90°.
Figure 3:
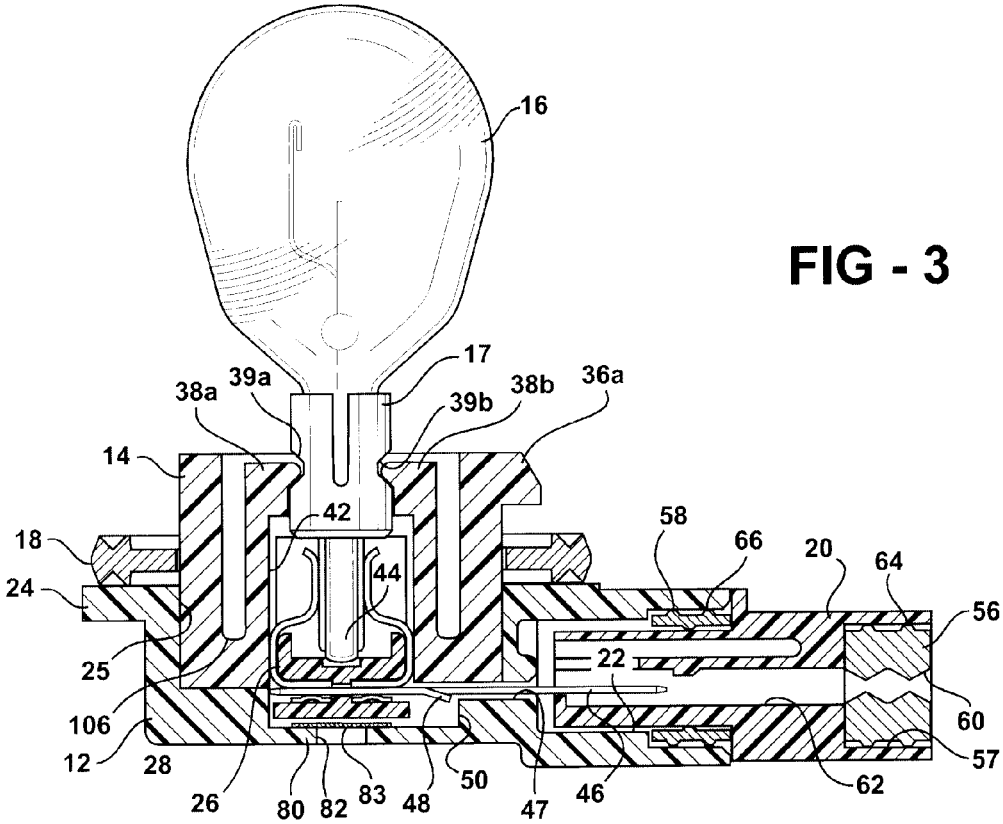
FIG. 3 is a cross sectional view of the socket assembly of FIG. 1 taken along line 3-3 of FIG. 2.

Referring to the Figures wherein like numerals indicate like or corresponding parts throughout the several views, FIGS. 1-4 show a preferred embodiment of the lamp socket assembly 10. The assembly includes a base or housing 12, a body 14, and a bulb or lamp 16 shown here as a two-filament lamp. It should be noted that the lamp socket assembly of the present invention can accommodate lamps with various numbers of filaments. The lamp includes a lamp base 17 which is inserted into lamp socket assembly 10. A flange seal 18 is provided for sealing the lamp socket assembly 10 to a panel, such as an automobile panel. A socket connector 20, as best shown in FIGS. 2 and 3, is inserted into a socket 22. Socket connector 20 includes electrical connector terminals (not shown) which are connected to wires (not shown) for connecting the lamp socket assembly to a source of electric power.

It should be noted that, while not illustrated herein, the socket assembly may be used with a sealed light assembly, such as an automobile tail light assembly. Such assemblies include a lens and a housing wherein the lens is sonically welded to the housing. Thus, moisture cannot enter the assembly except through the access holes into which the socket assemblies are inserted. By providing proper sealing of the socket assembly access holes, such as disclosed for the socket assembly according to the present invention, the entire light assembly is sealed. Thus the lamps or light bulbs will be internal to the light assembly and will be completely sealed as further described hereinafter. It should also be noted that such light assemblies may be used not only for tail lights for automobiles but also for the turning lights, running lights, etc. Furthermore, such assemblies may also be used in other vehicles such as, for instance, boats.

Flange seal 18 is seated on a mounting flange 24 and seals that flange and therefore the entire lamp socket assembly to an automobile panel.

The housing base 12 includes a socket cavity 25 in which a contact insert 26 is received. Contact insert 26 includes a plurality of contacts 28. The number of contacts 28 may vary depending upon whether the lamp socket assembly is intended for a single or double filament lamp. Contact insert 26 is captured in socket cavity 25 by means of body 14. Body 14 is sonic welded or secured in some other suitable fashion to base 12 as further described hereinafter.

Body 14 includes locking lugs 36*a*, 36*b*, and 36*c*. The locking lugs 36 are used to lock the entire socket assembly to a panel. Thus the panel would have only a relatively small opening therein including cut-out portions to accommodate locking lugs 36. Each of the locking lugs 36 has a different shape so that the assembly is keyed to the opening in the panel and cannot be inserted incorrectly. The entire lamp socket assembly is thus inserted into the panel aperture and, in the case of an automobile tail light, is inserted with the assembly base 12 extending into the trunk space and the glass envelope of the lamp 16 extending outside the trunk space into the sealed tail light assembly. Seal 18 provides a moisture barrier for the aperture of the tail light assembly. Lamp 16 is retained in lamp socket assembly 10 by means of retaining fingers 38 which are integrally molded with body 14 and are resiliently hingedly connected to the main part of body 14. Lamp base 17 includes a pair of grooves 39*a* and 39*b*. Retaining fingers 38 which have matching projections thereon for engaging grooves 39*a* and 39*b* retains the lamp 16 securely in the lamp socket assembly.

Thus when the lamp socket assembly 10 is installed in a tail light assembly, the panel would be captured between the bottom surfaces of lugs 36 and the top of flange seal 18. By compressing seal 18 to a predetermined pressure per square inch, the assembly would be properly sealed against moisture.

It should also be noted that by changing the portion of body 14 which extends upwardly from lugs 36, as shown in FIG. 1, the focal length of the lamp socket assembly can be varied. The focal length is the distance "a", shown in FIG. 1, between the bottom of lugs 36 and the location of the lamp filament Thus one advantage of the instant lamp socket design is that, by simply changing the length of the body 14 and the length of the contact insert 26, the focal length of the entire assembly can be varied while retaining the same base 12.

Body 14 includes a through passage 42 into which the lamp base 17 and the contact insert 26 is received. It can be seen in FIG. 2 that contact insert 26 includes a pair of contact insert posts 40, as further described hereinafter, between which lamp base 17 is received. Lamp base 17 includes contact wires 44 for contacting electrical contacts 28 to provide electric power to the lamp filaments. Blade terminals 46 in turn contact electrical contacts 28 as further explained hereinafter to provide the electrical connection between the wires leading up to the socket and contacts 28. Blade terminals 46 are captured in socket cavity 25 by means of struck out tabs 48 in the blade terminals and shoulder 50 in cavity 25 of housing 12. Thus, once the blade terminals 46 have been inserted into the assembly and capture contacts 28 therein, as explained hereinafter, the blade terminals 46 cannot be retracted or pulled out.

The entire assembly includes further seals for reducing the risk that moisture will reach the interior of socket cavity 25 and possibly corroding the electrical contacts. As best seen in FIG. 3, wire seal 56 is provided in a cavity 57 of socket connector 20. The wire seal includes a plurality of wire apertures through which the individual wires (not shown) extend. Seal 56 also includes ribs 64 to provide a positive moisture seal. Thus the risk that moisture will leak into the socket cavity past the connecting wires is substantially reduced. A ring seal 58 is provided around socket connector 20 to seal the socket connector 20 in socket 22 of base 12. It should be noted that ribs 66 are provided to improve a positive seal. Socket wire seal 56 and ring seal 58 are preferably manufactured of a resilient and flexible material such as, for instance, silicone. Similarly, flange seal 18 is preferably manufactured of a resilient and flexible material such as silicone. By means of the three seals 18, 56, and 58, the interior of cavity 25 is substantially sealed against moisture, although there is always some risk that moisture will be able to enter socket cavity 25 from the ambient space.

Referring now to FIGS. 5-8, the base or housing 12 of the socket assembly is shown. In particular, by referring to FIG. 5, it can be seen that a plurality of energy directors or ribs are provided on the bottom surface of the socket cavity 25. By referring to the detailed partial view of FIG. 7, it can be seen that triangular portions 72 are provided on the top surfaces of the energy directors 70. Energy directors 70 are used for welding the body 14 to base 12 by means of sonic welding. The provision of the energy directors 70 ensures secure attachment of the body and base.

Figure 6:
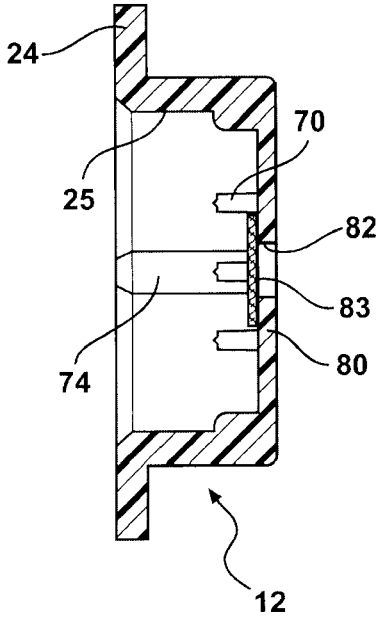
FIG. 6 is a cross sectional view of the housing of FIG. 5 taken along lines 6-6 thereof.
Figure 7:
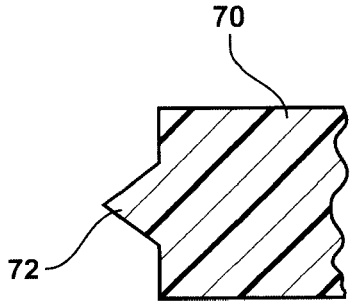
FIG. 7 is an enlarged detailed view of the upper portion of an energy director shown in FIG. 5.
Figure 8:
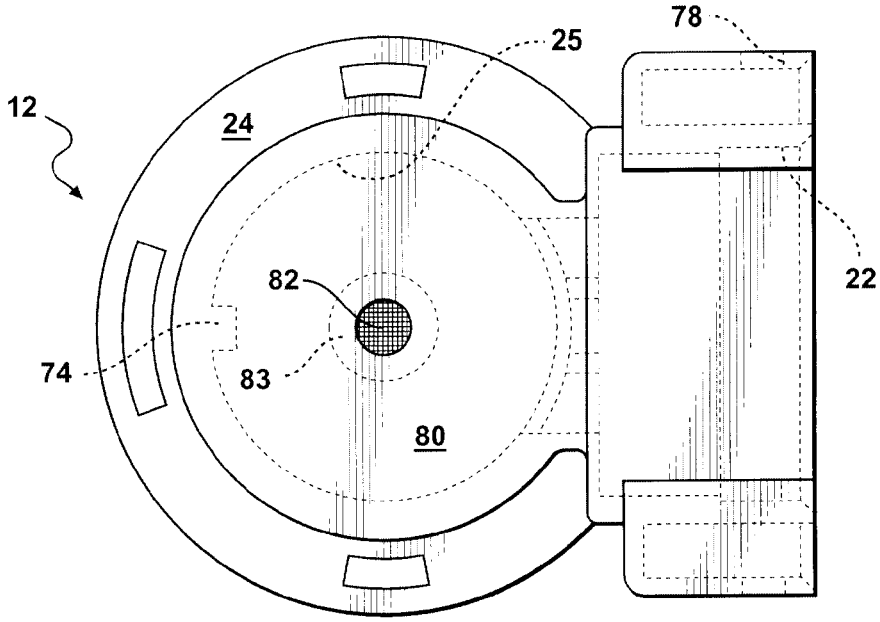
FIG. 8 is a bottom plan view of the housing of FIG. 5.

It should be noted, by reference to FIG. 3, that energy directors 70 extend axially upwardly in cavity 25 from the bottom wall 80 of the cavity. The number of energy directors 70, their height and thickness as seen in FIG. 6, and their spacing is critical.

As further illustrated in FIG. 1, the space between the bottom surface of lugs 36 and the top surface of mounting flange 24 must be closely held during the assembly of body 14 to housing 12 in order to achieve the proper compression of seal 18 in the mounting of lamp socket assembly in a panel (not shown). By selecting the proper height, thickness, spacing and number of energy directors, this space for accommodating the panel thickness can be closely held.

Base 12 also includes a key 74 which is used for properly orienting body 14 with regard to base 12. Two contact insert keys 76 are also provided in cavity 25 to properly locate contact insert 26 in cavity 25. Socket 22 includes a pair of windows or apertures 78 for securement therein of a pair of fingers (not shown) which are part of socket connector 20 and which lock socket connector 20 to housing 12.

As best shown in FIGS. 3, 5, 6, 8, 9, 30, 31 and 33-35, a vent hole 82 is formed in the bottom wall 80 for the purpose of equalizing pressure within the installed lamp enclosure, and for allowing any accumulated moisture or vapors to escape. Moisture can infiltrate the seals 56, 58, or trapped vapors can be the natural result of material outgassing, or temperature differentials can result in the ingress or egress of air in the interstitial spaces between socket cavity 25 and lamp socket 14. The vent hole 82 is covered on the interior side by a patch of hydrophobic and/or oleophobic membrane 83. As is known in the art, hydrophobic membranes repel water from entering the lamp enclosure while permitting air, vapors and moisture to evacuate through the vent hole 82, whereas an oleophobic membrane will repel oils. Such membranes can be made of woven fabric obtained commercially from companies like Gore and Nitto Denko. For example, a suitable hydrophobic and/or oleophobic material may be found by reference to U.S. Pat. No. 6,210,014 assigned to Gore Enterprise Holdings, the entire disclosure of which is hereby incorporated by reference.

The decision whether to use a hydrophobic or oleophobic material for the membrane 83 is largely determined by the intended application. Ideal applications for a hydrophobic membrane vent patch 83 are those that are exposed to water. Using a hydrophobic type membrane allows the lamp assembly 10 to maintain a stable internal pressure while preventing water from contaminating the socket cavity 25. By contrast, in applications where low surface tension fluids are more likely to come in contact with the lamp assembly 10, an oleophobic membrane material is preferred. This is because low surface tension fluids have a smaller contact angle than high surface tension fluids like water. Low surface tension liquids can penetrate the pores of a hydrophobic membrane and result in total loss of airflow through the membrane. Oleophobic materials are specially designed to resist wet-out from low surface tension fluids, and can be obtained commercially from companies like Gore. In some applications, where both water and oil-based infiltration is likely, it would be possible to use both hydrophobic and oleophobic materials for the vent patch 83. These may either be combined in one integrally woven material, or in a multi-layered form.

The vent hole 82 can be formed in the bottom wall 80 by either a drilling or molding operation, after which the hydrophobic vent patch 83 is affixed such as by adhesive, sonic welding, or other appropriate technique. Preferably, although not necessarily, the vent hole 82 is round, and the vent patch 83 may also have a generally round shape. However, the vent patch 83 is formed considerably larger than the size of the vent hole 82 so that the vent patch 83 overlies the entirety of the vent hole 82 with overlapping edges. It is these overlapping edges that are glued, welded, or in some other manner affixed to the inner surfaces of the bottom wall 80. In applications where the socket cavity 25 is generally cylindrical, such that it is centered about an imaginary axis that passes through the bottom wall 80 of said housing 12, the vent hole 82 may also be aligned along imaginary axis. However, it is not critical that the vent 82 intersect the imaginary central axis of the socket cavity 25, and instead be located at some other strategic location communicating with the socket cavity 25. Furthermore, in some cases it may be desirable to include more than one vent hole 82 which is covered by a common vent patch 83 or each by dedicated vent patches 83.

The method for venting moisture from the confines of a sealed lamp assembly 10 through a vent hole 82 in the socket cavity 25 comprising the steps of: providing a housing 12 having a socket cavity 25 defined by side walls and a bottom wall 80; forming a vent hole 82 though the bottom wall 80 of the socket cavity 25; inserting a lamp socket 14 in the socket cavity 25 of the housing 12; inserting the base 17 of a lamp 16 in the lamp socket 14; forming a vent patch 83 from a hydrophobic and/or oleophobic fabric material; and covering the vent hole 82 with the vent patch 83 applied from the inside of the socket cavity 25.

The method according to this invention is particularly conducive to fully automated manufacturing processes which result in product being manufactured at minimal cost and effort. Furthermore, the subject technique has shown better moisture evacuation over prior art venting methods. The invention eliminates the need to design a venting system within the lamp construction, as taught by many prior art systems. Rather, the vent system is incorporated into the socket feature, thus making the design and construction of the lamp housing less costly. By eliminating the hole through the housing, as taught by prior art designs, a potential visual impact is also avoided. Likewise, there is no need to design camouflaging features that hide the vent hole.

A further advantage of this invention is understood by a comparison to the prior art technique by which the vent hole was manually formed in a lamp housing, which substantially increased cost and slowed the production through-put. The subject invention eliminates this cumbersome process from the lamp housing manufacturing process. For the subject socket assembly 10, the vent hole 82 can be fully automated into the manufacturing process at minimal cost and effort. And finally, testing has demonstrated that the subject technique provides better moisture evacuation over current production methods.

Referring now to FIGS. 10-14, body 14 is shown. The body includes a through aperture or passage 42 and a pair of ribs 90 therein. These ribs guide lamp base 17 when it is inserted into the through passage 42. Retaining fingers 38 are molded integrally with body 14 and are hinged at 106. Fingers 38 are therefore resiliently connected and are biased inwardly into through passage 42 so that they firmly grasp a lamp base 17. The fingers can move outwardly into spaces 92 located directly behind fingers 38. Slots 93 are located immediately adjacent to fingers 38. A key slot 94 is provided in body 14 to cooperate with key 74 in socket cavity 25 to properly orient body 14 during assembly thereof to base 12. A further slot 96 is provided in the lower portion of body 14 for accommodating contact insert 26 during assembly thereof to base 12 and body 14. One or more ribs 98 are provided on the bottom of body 14 for cooperating with energy director 70 and for welding body 14 to base 12. Some of the energy directors 70 also contact bottom surface 100 of body 14 for securement thereto by means of sonic welding.

Figure 13:
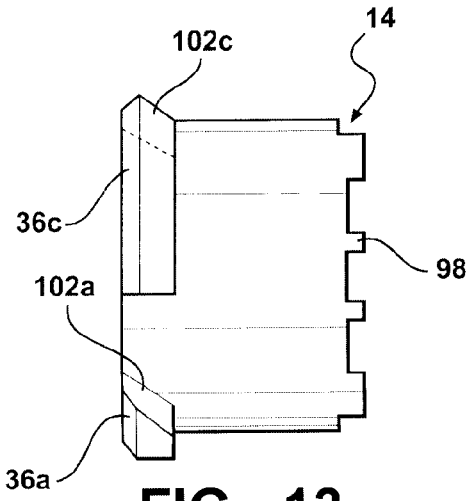
FIG. 13 is a side view of the body of FIG. 10 taken from the right hand side thereof.
Figure 14:
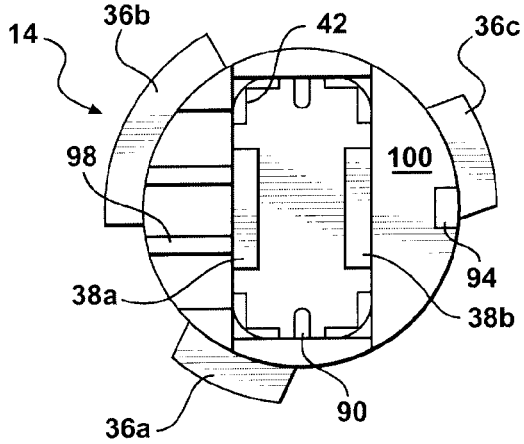
FIG. 14 is a bottom plan view of the body of FIG. 10.

By referring to FIGS. 1 and 13, it can be seen that lugs 36 include camming surfaces 102. Camming surfaces 102 enable the lamp socket assembly to be properly assembled to an automobile panel or tail light housing by camming over the surface of the automobile panel or tail light housing to provide sufficient pressure between flange seal 18 and the panel or housing to form a proper seal. Lastly, shoulders 104 are provided in through passage 42 to accommodate and guide a lamp base 17 during its insertion thereof into through passage 42.

Base 12, body 14, and contact insert 26 and socket 20 may all be molded from a suitable insulating material such as, for instance, nylon which may be glass filled. This material is sufficiently rigid so that it cooperates properly with flexible resilient seals 18, 56, and 58 to properly seal the structure against moisture as described hereinabove.

Figure 4:
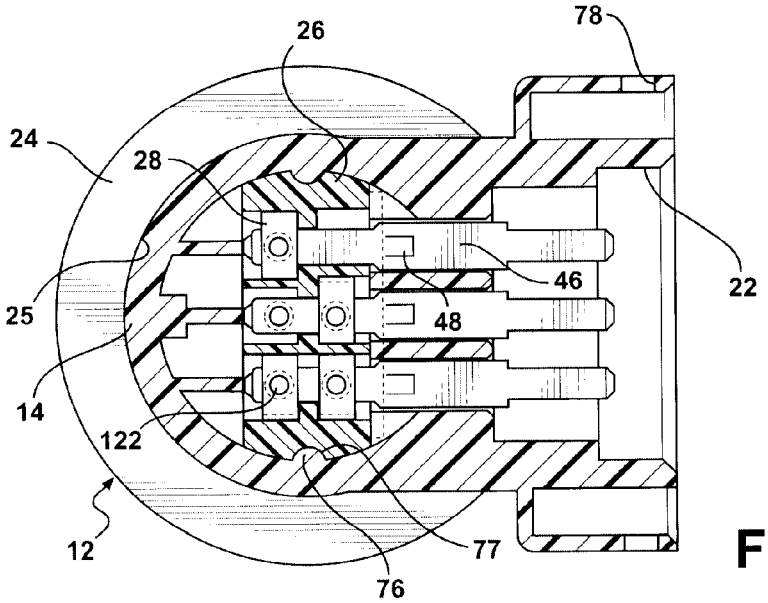
FIG. 4 is a cross sectional view of the lamp socket assembly of FIG. 1 taken along line 4-4 thereof.
Figure 5:
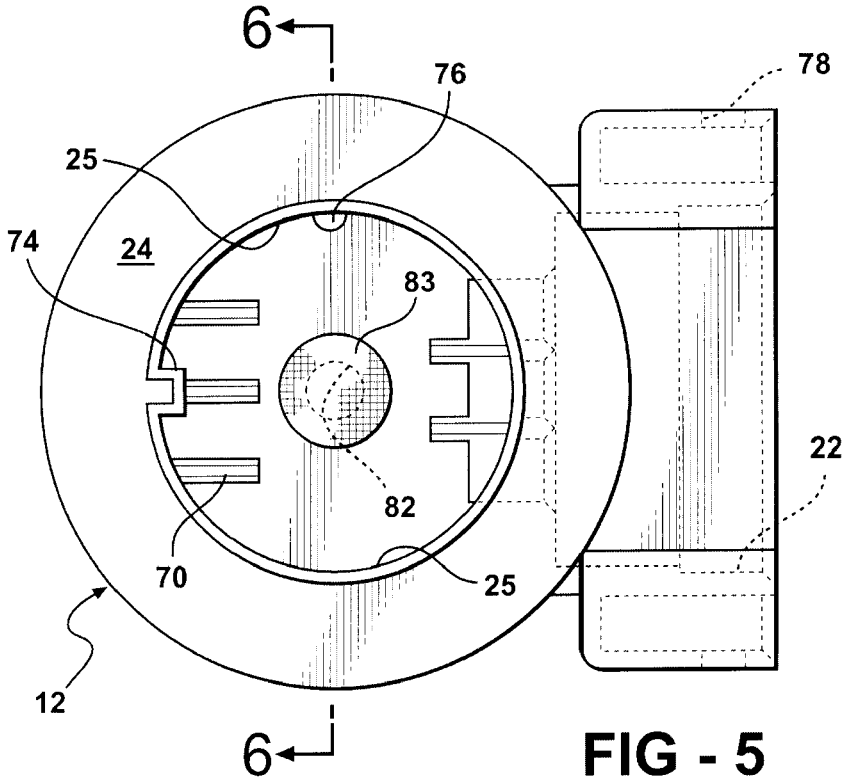
FIG. 5 is a top plan view of the housing for the socket assembly of FIG. 1.

Turning now to FIGS. 15-18, electrical contacts 28 for the lamp socket assembly 10 are illustrated. The contacts are constructed of a suitable conductive material, such as brass. The contacts include U-shaped bent portions 114 which have a window 116 therein for insertion of blade terminals 46 therethrough as shown in FIGS. 3 and 4. The contacts 28 include a contacting portion 118 and a bent portion 119 for contacting lamp contact wires 44. U-shaped bent portion 114 includes a bottom leg 124 and an upper leg 126. Upper leg 126 includes a struck out protrusion 122 for providing proper contact with blade terminal 46 during insertion thereof into the assembly.

Figure 15:
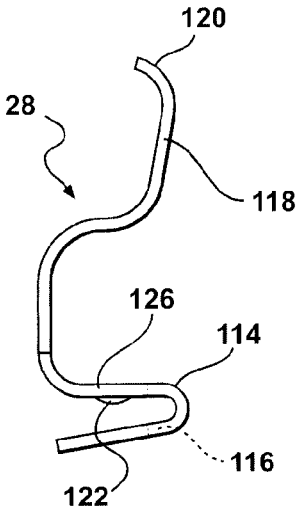
FIG. 15 is a front elevational view of a terminal for the lamp socket assembly of FIG. 1.
Figure 16:
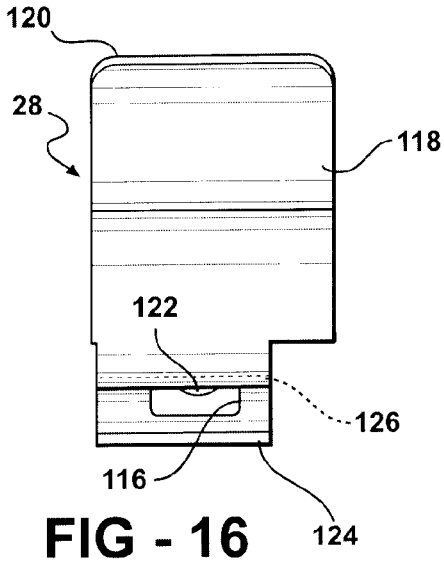
FIG. 16 is a side elevational view of the terminal of FIG. taken from the left hand side thereof.
Figure 17:
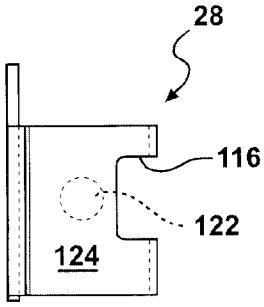
FIG. 17 is a bottom plan view of the terminal of FIG. 15.
Figure 18:
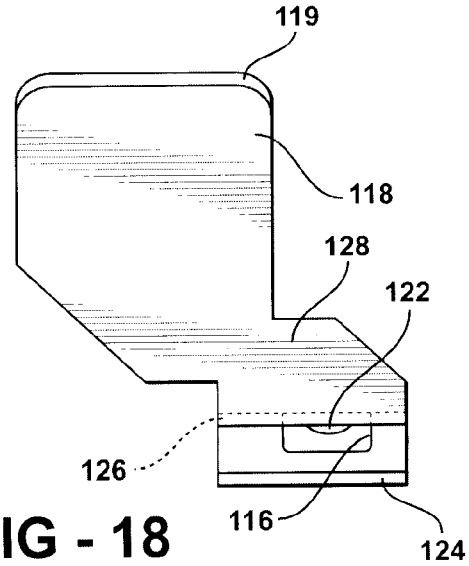
FIG. 18 is a side elevational view of another terminal for the socket assembly of FIG. 1.

FIGS. 15, 16, and 17 show a terminal for the assembly. FIG. 18 shows a ground terminal for the assembly. The ground terminal has an offset portion 128 whereby the terminal may be inserted into the contact insert in one lateral location whereas the main body of the terminal is offset from that location for proper contact.

Figure 19:
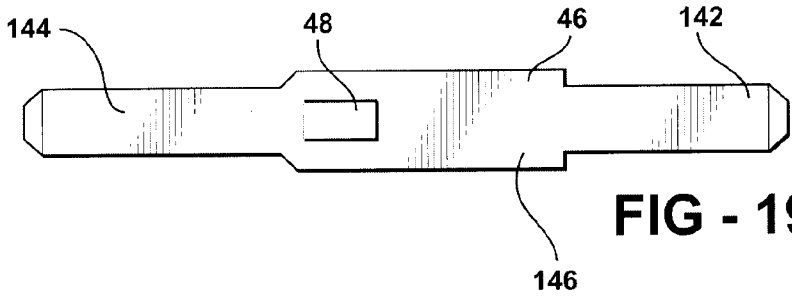
FIG. 19 is a front elevational view of a blade terminal for the socket assembly of FIG. 1.
Figure 20:
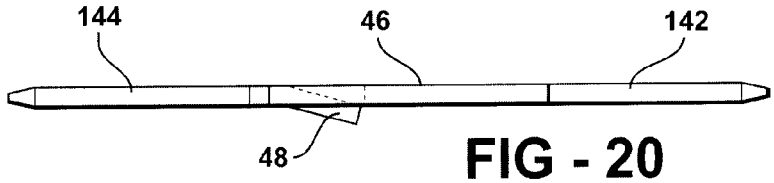
FIG. 20 is a side elevational view of the blade terminal of FIG. 19.
Figure 21:
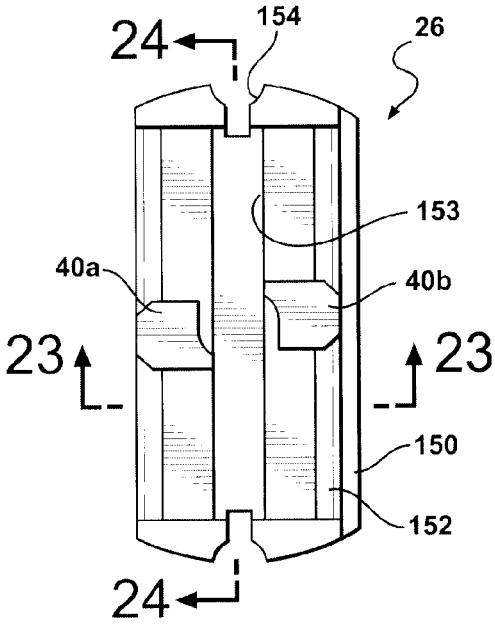
FIG. 21 is a top plan view of a contact insert for the socket assembly of FIG. 1.
Figure 22:
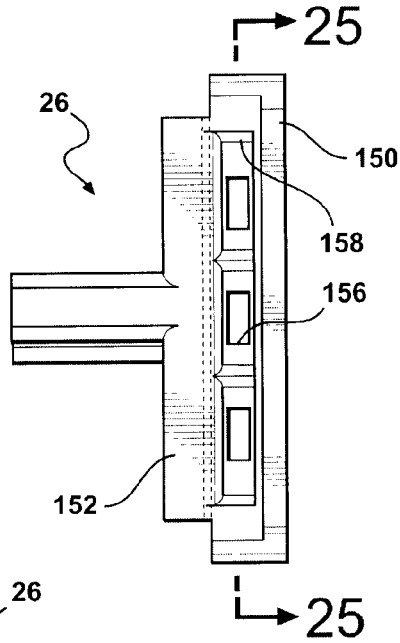
FIG. 22 is a side elevational view of the contact insert of FIG. 21.
Figure 23:
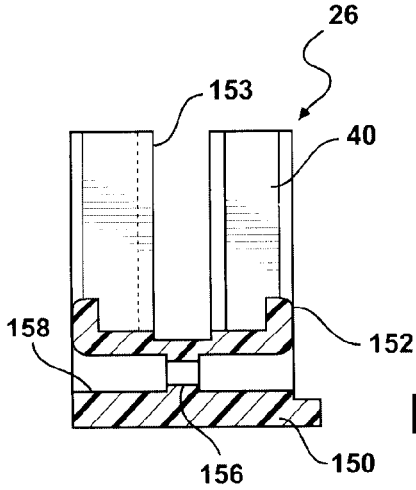
FIG. 23 is a cross sectional view of the contact insert of FIG. 21 taken along line 23-23 thereof.
Figure 24:
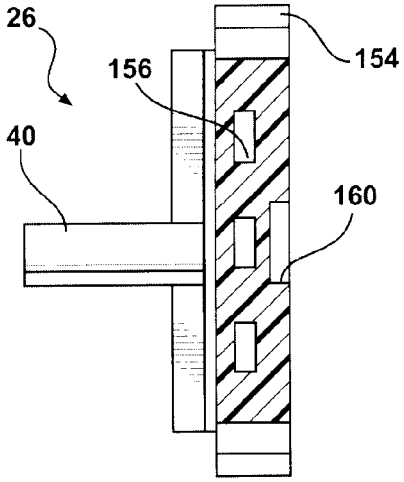
FIG. 24 is a cross sectional view of the contact insert of FIG. 21 taken along line 24-24 thereof.
Figure 25:
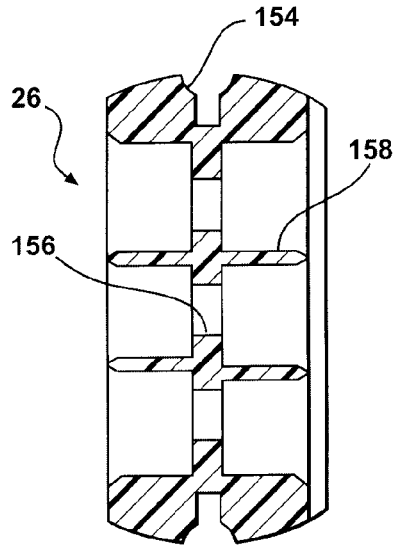
FIG. 25 is a cross sectional view of the contact insert of FIG. 21 taken along line 25-25 of FIG. 22.

FIGS. 19 and 20 show a blade terminal Blade terminal 46 is a planar terminal having two end portions 142, 144 which are somewhat thinner than central portion 146. Central portion 146 includes a struck out tab 48 for preventing blade terminal 46 from being pulled out of the socket assembly once it has been assembled thereinto. End portion 144 is inserted into the base 12 through a window 116 of a contact 28 as further explained hereinafter. End portion 142 extends into socket 22 for contacting a terminal (not shown) in socket connector 20.

FIGS. 21-25 show a contact insert 26. Contact insert 26 includes a base 150 which is generally planar. A pair of walls 152 are integrally formed with base 150 and extend upwardly therefrom to form a groove 153 therebetween. Key slots 154 are provided at either end of base 150 for cooperating with keys 76 in socket cavity 25 of base 12 for properly orienting the contact insert 26 during assembly thereof to base 12. Additionally a key aperture 160 is provided centrally of base 150 for proper orientation of the contact insert 26 during assembly thereof to base 12. Base 150 includes a plurality of windows 156 and slots 158 for accommodating contacts 28 and blade terminals 46. Posts 40 are formed integrally with and extend upwardly from base 50 for properly guiding a lamp base 17 into groove 153.

Figure 26:
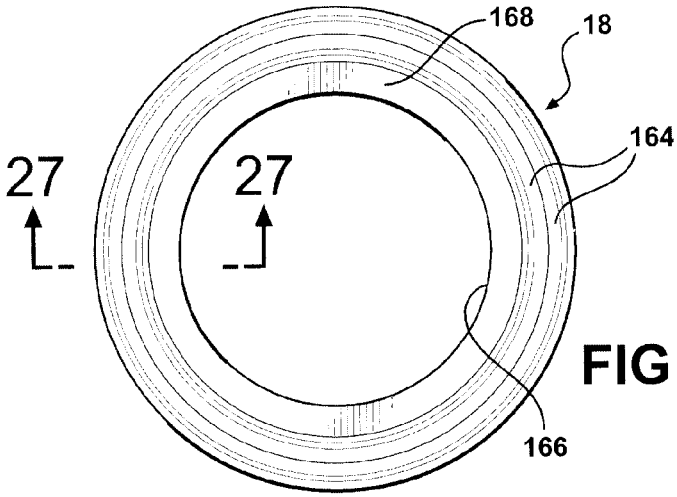
FIG. 26 is a top plan view of a flange seal for the socket assembly of FIG. 1.
Figure 27:
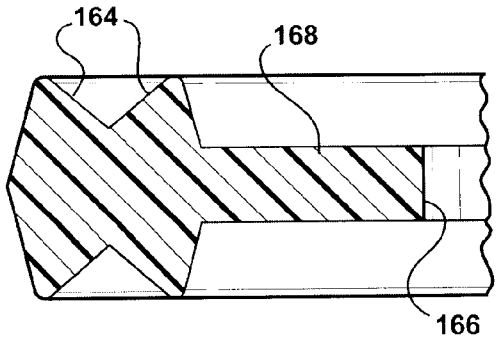
FIG. 27 is an enlarged cross sectional view of the flange seal of FIG. 26 taken along line 27-27 thereof.

FIGS. 26 and 27 show the flange seal 18. The flange seal comprises a flange 168 with a pair of upstanding ribs 164 at the outer perimeter thereof. An aperture 166 is provided in the flange seal for accommodating body 14.

Referring now to FIGS. 1-3, the lamp socket assembly is assembled as follows. Molded contact insert 26 is first assembled with a set of contacts 28. The U-shaped bent portion 114 of each contact is inserted into the appropriate slot 158 of base 150 of the contact insert with the rounded portion 118 of the contact facing groove 153. Since the material from which the contacts 28 are made is somewhat resilient, the contacts are resiliently retained in slots 158. Contact insert 26 is then inserted into cavity 25 of base 12. Because of the location of keys 76 and 82, improper assembly of the contact insert 26 in base 12 is prevented. Body 14 is now inserted into socket cavity 25 and is properly oriented therein by means of key 74 and key slot 94. Body 14 captures contact insert 26 in cavity 25 by engagement of contact insert base 50 in contact insert slot 96 of body 14. Thus the contact insert is properly captured and is immovably fixed in socket cavity 25. The assembly is now subjected to sonic welding or another suitable welding technique which is applied to bottom 80 of base 12. Sonic welding is a well known process and therefore need not be explained further herein. The provision of energy directors 70 with upstanding triangular ribs 72 thereon provides proper guidance to the energy applied by the sonic welding process to provide melting of portions 72 and securement of body 14 to base or housing 12. If sonic welding is used, as explained hereinbefore, the thickness and height of the energy directors 70 is critical for the particular spacing and number of energy directors shown. The energy directors are axially oriented with respect to the cavity 25 and body 14. Thus as the body and housing are welded together, the energy directors will melt and the body 14 will enter the cavity 25 further. Sonic welding will be stopped when the distance between the bottom surface of lugs 36 and the top surface of mounting flange 24 is within prescribed limits. By proper design of axial energy directors 70, the strength and uniformity of the sonic weld will be within acceptable tolerances.

An appropriate number of blade terminals 46 are now inserted through windows 47 of base 12, windows 156 of contact insert 26 and windows 116 of contacts 28, thereby capturing the contacts 28 firmly in contact insert 26 and the contact insert in base 12. Blade terminals 46 are retained in the assembly by means of tabs 48 which interlock with blade retaining shoulder 50 of base 12. A socket insert 20 is now provided with seals 56 and 58 and with appropriate wires and contact terminals (not shown). Socket 20 is inserted into socket 22 to complete the assembly. It can thus be seen that the entire assembly is extremely simple and forms a sealed structure to prevent contamination and corrosion of the electrical contacts by moisture. Furthermore, it can be seen that the portion of the socket assembly extending into the trunk space of an automobile, namely base or housing 12, is very small indeed. The typical extension of the base 12 into the trunk area is ½" or less.

Figure 9:
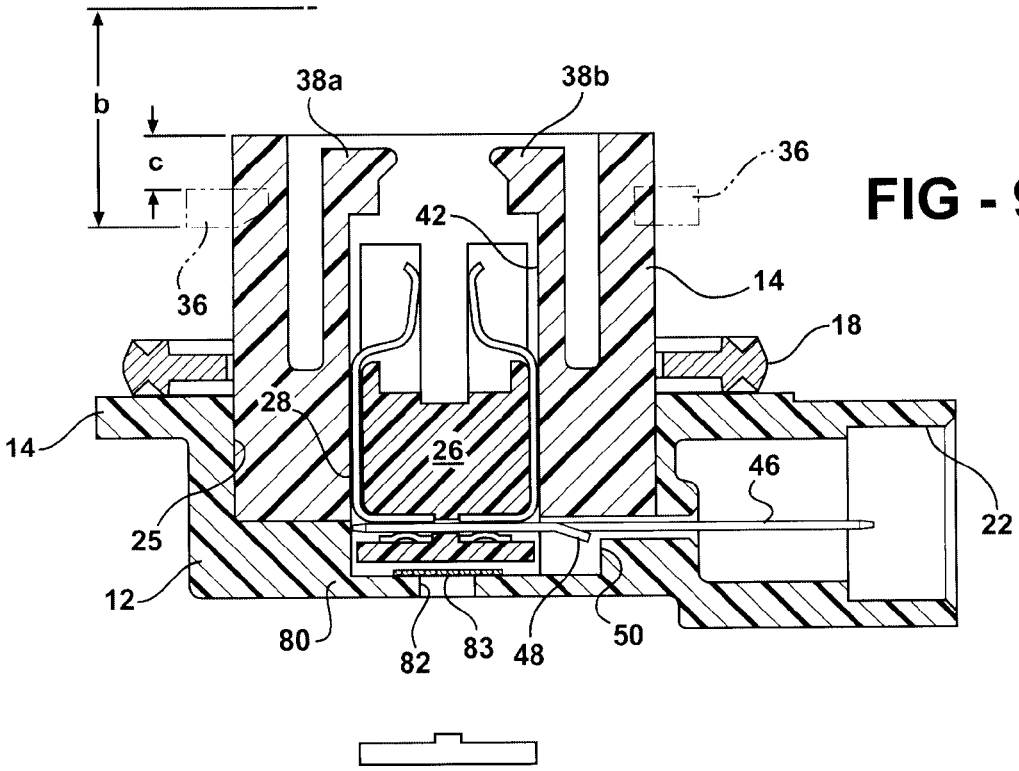
FIG. 9 is a cross sectional view of an embodiment of a socket assembly according to the present invention with a different focal length.
Figure 10:
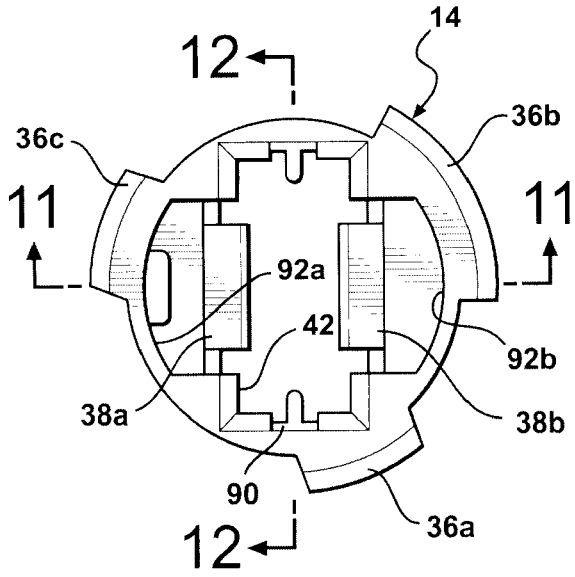
FIG. 10 is a top plan view of a body for the socket assembly of FIG. 1.
Figure 11:
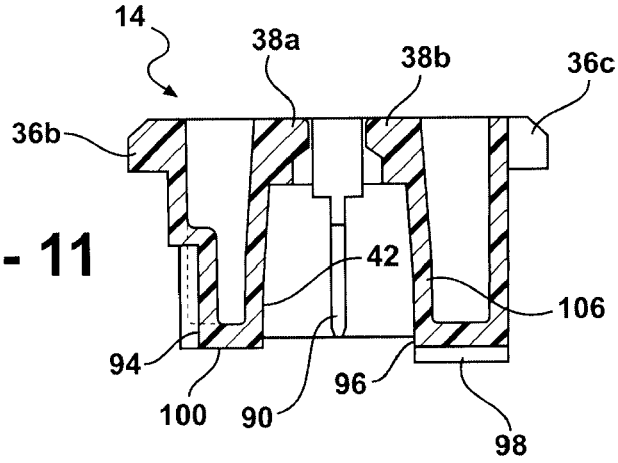
FIG. 11 is a section of the body of FIG. 10 taken along line 11-11 thereof.
Figure 12:
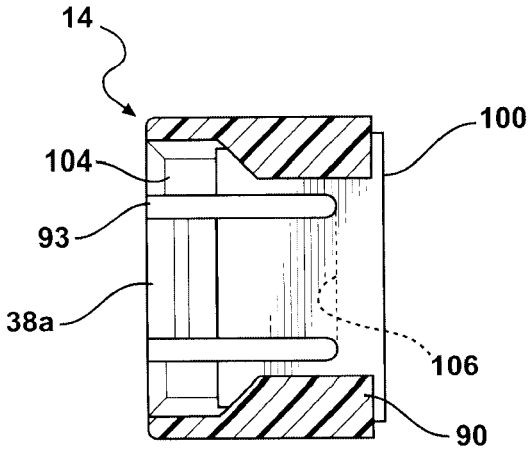
FIG. 12 is a sectional view of the body of FIG. 10 taken along line 12-12 thereof.

Referring now to FIG. 9, it can be seen that various assemblies with different focal lengths may be provided utilizing the same basic socket assembly design. By referring to the focal length "a" of FIG. 1 and comparing this to the focal length "b" of FIG. 9, it can be seen that they are different. The focal length is defined as the distance from the bottom of lugs 36 to the filament location. The body 14 of the assembly of FIG. 9 has a higher extension "c" extending beyond the top surface of lugs 36 (schematically illustrated) than the body 14 illustrated in FIG. 1. Therefore the focal length of the assembly of FIG. 9 is different and longer than the focal length of the assembly of FIG. 1. By varying the distance "c", the focal length of the structure can be changed in a very simple manner. Base 12 of the assembly FIG. 9 is identical to the base 12 of the assembly of FIG. 1. Thus, the longer focal length of the assembly of FIG. 9 is accompanied by an identical extension of base 12 into the trunk space of the automobile. The assembly of FIG. 9 also utilizes a different contact insert 26 and contacts 28 than the assembly of FIG. 1 in order for the lamp base 17 to be able to reach contacts 28. The contacts 28 of FIG. 9 also have longer extensions as can be seen by comparing the contacts 28 of FIGS. 3 and 9. Thus, it can be seen that the structure can be adjusted for a variety of focal lengths by the simple provision of a different body 14, contact insert 26, and contacts 28. The extension of the assembly into the useable trunk space remains the same.

Figure 28:
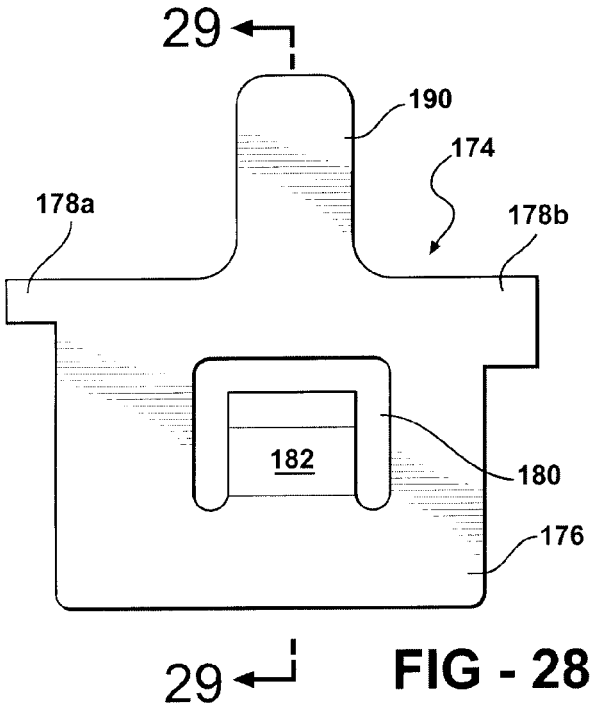
FIG. 28 is a top plan view of a locking wedge for use with an alternative embodiment of the lamp socket assembly according to the present invention.
Figure 29:
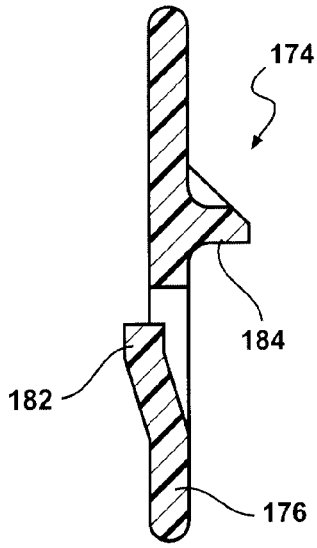
FIG. 29 is a side elevational view of the locking wedge of FIG. 28.
Figure 30:
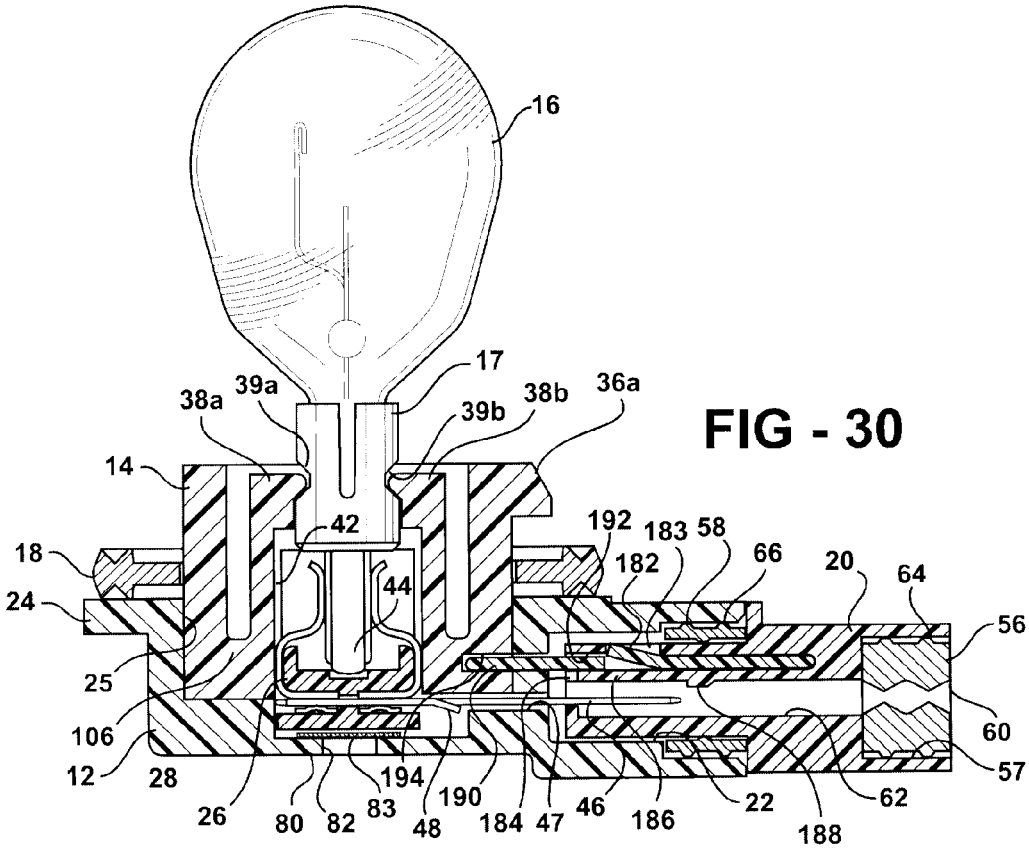
FIG. 30 is a cross sectional view of an alternative embodiment of a socket assembly including the locking wedge of FIG. 28.

Referring now to FIGS. 28-30, there is shown a further embodiment of the present invention including a locking wedge which locks together base 12 and body 14. The locking wedge is inserted into a slot 172 of the socket connector 20. The locking wedge includes a planar tab portion 176 having a pair of shoulders 178*a* and 178*b* which are keyed with respect to slot 172 so that the locking wedge can only be inserted in a desired orientation. Tab 176 includes a U-shaped slot 180 which forms a wedge locking tab 182 and which is so molded as to extend resiliently upwardly as shown in FIG. 30. Thus, wedge locking tab 182, upon insertion of locking wedge 174 into slot 172, will snap into space 183 to prevent the locking wedge from being pulled out of connector 20. Stops 184 abut against connector 20 to prevent locking wedge 174 from being inserted too far into slot 172. The purpose of the locking wedge is to prevent the resilient fingers 186 of connector 20 from being displaced upwardly and to ensure that locking tabs 188 of fingers 186 will engage with the connectors (not shown) to provide proper contact thereof with blade terminals 46.

Locking wedge 174 also includes a snout or protrusion 190 which, upon insertion of connector 20 into socket 22, will be inserted into aperture 192 of housing 12 and aperture 194 of body 14. Apertures 192 and 194 are aligned whereby snout 190 may be simultaneously inserted thereinto.

Snout 190 ensures that body 14 will be locked in place, even if the weld connecting body 14 to housing 12 should fail. Thus, upon insertion of the socket connector 20, the entire socket assembly is locked together.

While the protrusion 190 is located on the locking wedge it should be noted that it could be placed elsewhere on the socket connector.

Figure 31:
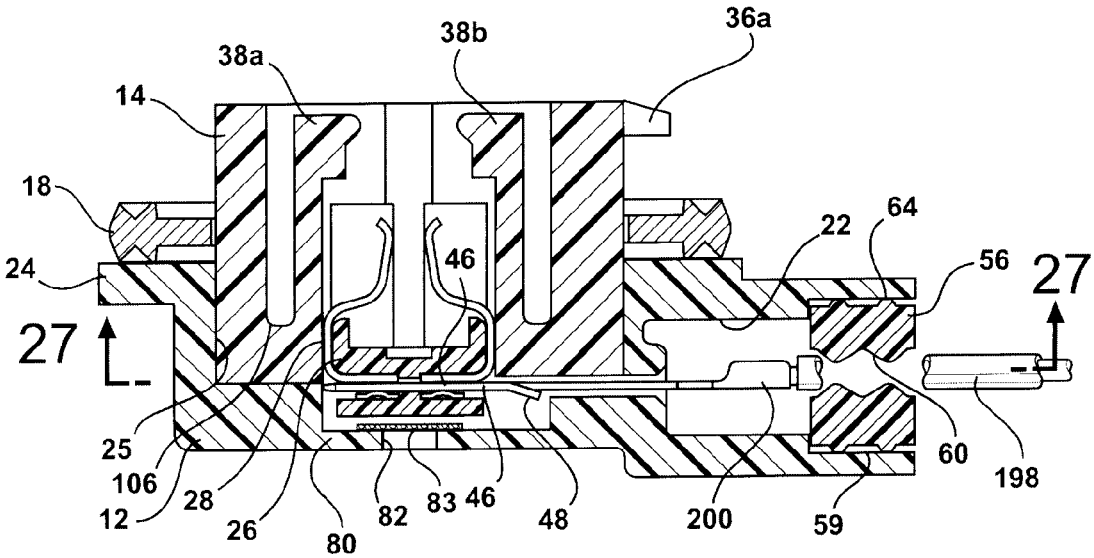
FIG. 31 is a cross sectional view of a connectorless alternative embodiment of a socket assembly according to the present invention.
Figure 32:
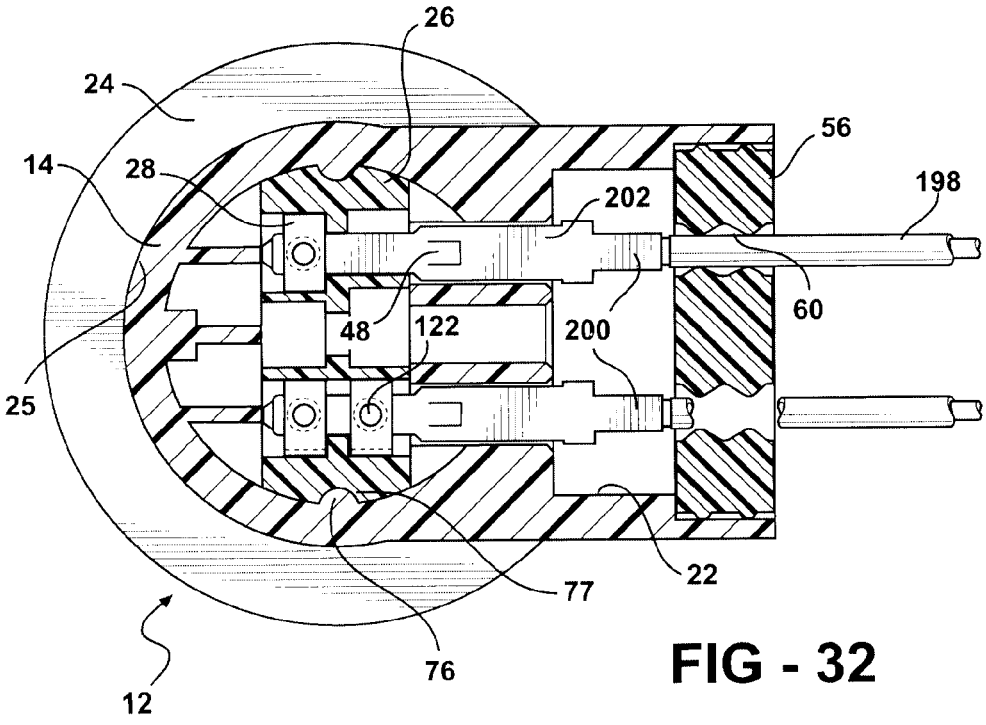
FIG. 32 is a cross sectional view of the socket assembly of FIG. 31 along lines 32-32 of FIG. 31.

Referring now to FIGS. 31 and 32, there is shown an alternative embodiment of the invention. These figures disclose a connectorless socket assembly. Instead of the use of a socket connector including contacts for connecting with blade terminals 46, this embodiment does not use a socket connector. Rather, wires 198 are directly crimped to blade terminals 202 by means of crimps 200. Alternatively, wires 198 could be soldered to the blade terminals 202. The wires are sealed in socket 22 of housing 12 by means of a wire seal 56 as described hereinabove. In the assembly of this embodiment, the blade terminals are crimped to wires 198, a seal 56 is then slipped over the blade terminals and wires 198, the blade terminals 202 are then inserted into the socket assembly and the seal is placed into socket 22 to seal the wires 198. Thus, in this particular version, a connector would be placed downstream of wires 198. Further, several socket assemblies could be connected to a single connector. For instance, in a tail light assembly of an automobile, several socket assemblies such as, for instance, three, might be used whereas a single connector would be used to connect three socket assemblies to the wiring harness of the automobile.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A lamp and socket assembly comprising:

a housing including a socket cavity, said socket cavity defined by side walls and a bottom wall;

said housing including a vent hole passing though said bottom wall of said socket cavity;

a lamp having a lamp base;

a lamp socket disposed in said socket cavity of said housing, said lamp socket further including a through passage for receiving said lamp base therein and at least one retaining finger for retaining said lamp base in said through passage;

an electrical contact insert received in said socket cavity;

a plurality of electrical contacts received in and retained by said contact insert;

a plurality of blade terminals interlocked with said contact insert, respective ones of said contacts, and said housing; and a hydrophobic and/or oleophobic vent patch applied over said vent hole on an interior of said bottom wall, said vent patch being positioned in between said contact insert and said bottom wall of said socket cavity and completely covering said vent hole to abrasive damage and therefore provides extended service life;

wherein said vent patch is fabricated from a fabric material.

2. The assembly of claim 1 wherein said vent hole is generally round.

3. The assembly of claim 2 wherein said vent patch is generally round.

4. The assembly of claim 3 wherein said vent patch is generally centered over vent hole.

5. The assembly of claim 1 wherein said lamp socket is generally cylindrical and centered about an imaginary axis passing through said bottom wall of said housing, said vent hole intersecting said imaginary axis.

6. A lamp and socket assembly comprising:

a housing (12) including a socket cavity (25), said socket cavity defined by side walls and a bottom wall (80);

said housing including a vent hole passing though said bottom wall of said socket cavity;

a lamp having a lamp base;

a lamp socket (14) disposed in said socket cavity of said housing, said lamp socket including a plurality of camming lugs (36*a*, 36*b*, 36*c*) for retaining said lamp socket assembly in a mounted position in an apertured panel, said lamp socket further including a through passage (42) for receiving said lamp base therein and at least one retaining finger (38*a/b*) for retaining said lamp base in said through passage;

an electrical contact insert received in said socket cavity, said contact insert including a groove for receiving said lamp base therein, a plurality of electrical contacts received in and retained by said contact insert;

a plurality of blade terminals interlocked with said contact insert, respective ones of said contacts, and said housing; and a vent patch fabricated from a hydrophobic and/or oleophobic material, said vent patch applied over said vent hole on an interior of said bottom wall, said vent patch being positioned in between said contact insert and said bottom wall of said socket cavity and completely covering said vent hole to abrasive damage and therefore provides extended service life;

wherein said vent patch is fabricated from a fabric material.

7. The assembly of claim 6 wherein said vent hole is generally round.

8. The assembly of claim 7 wherein said vent patch is generally round.

9. The assembly of claim 8 wherein said vent patch is generally centered over vent hole.

10. The assembly of claim 6 wherein said lamp socket is generally cylindrical and centered about an imaginary axis passing through said bottom wall of said housing, said vent hole intersecting said imaginary axis.

11. A method for venting moisture from the confines of a sealed lamp assembly through a vent opening in the socket, said method comprising the steps of:

providing a housing having a socket cavity defined by side walls and a bottom wall;

forming a vent hole though the bottom wall of the socket cavity;

inserting a lamp socket having an electrical contact insert in the socket cavity of the housing;

inserting the base of a lamp in the lamp socket;

forming a vent patch from a hydrophobic and/or oleophobic fabric material; and covering the vent hole with a vent patch applied on an interior of said bottom wall, said vent patch being positioned in between said contact insert and said bottom wall of said socket cavity and completely covering said vent hole to abrasive damage and therefore provides extended service life;

wherein said vent patch is fabricated from a fabric material.

12. The method of claim 11 wherein said step of forming a vent patch includes cutting the vent patch to a size greater than the size of the vent hole so that the vent patch overlies the entirety of the vent hole with overlapping edges.

13. The method of claim 12 wherein said step of cutting the vent patch to size includes shaping the edges of the vent patch in a generally circular shape.

14. The method of claim 12 wherein said step of covering the vent hole includes generally centering the vent patch over the vent hole.

15. The method of claim 12 wherein said step of covering the vent hole includes affixing the vent patch over the vent hole with an adhesive.

16. The method of claim 12 wherein said step of covering the vent hole includes welding the vent patch to the bottom wall.

* * * * *